US008668438B2

(12) United States Patent
Saroi

(10) Patent No.: US 8,668,438 B2
(45) Date of Patent: Mar. 11, 2014

(54) TURBINE CASING COOLING

(75) Inventor: Rajinder Saroi, Derby (GB)

(73) Assignee: Rolls-Royce PLC, London (GB)

( * ) Notice: Subject to any disclaimer, the term of this patent is extended or adjusted under 35 U.S.C. 154(b) by 421 days.

(21) Appl. No.: 12/724,869

(22) Filed: Mar. 16, 2010

(65) Prior Publication Data

US 2010/0266393 A1 Oct. 21, 2010

(30) Foreign Application Priority Data

Apr. 16, 2009 (GB) ..... 0906478.3

(51) Int. Cl.
*F01D 11/24* (2006.01)

(52) U.S. Cl.
USPC ..... 415/116; 415/173.1; 415/173.2; 415/175; 415/176; 415/178

(58) Field of Classification Search
USPC ..... 415/173.1–173.5, 175–178, 115–117
See application file for complete search history.

(56) References Cited

U.S. PATENT DOCUMENTS

| | | | | |
|---|---|---|---|---|
| 2,618,461 | A * | 11/1952 | Frankel et al. | 415/178 |
| 3,907,458 | A | 9/1975 | Liddle | |
| 4,859,142 | A * | 8/1989 | Burke et al. | 415/116 |
| 5,980,201 | A | 11/1999 | Benoist et al. | |
| 6,035,929 | A * | 3/2000 | Friedel et al. | 415/173.2 |
| 6,089,821 | A | 7/2000 | Maguire et al. | |
| 6,185,925 | B1 | 2/2001 | Proctor et al. | |
| 6,896,038 | B2 * | 5/2005 | Arilla et al. | 415/115 |
| 7,108,479 | B2 * | 9/2006 | Beverley et al. | 415/115 |
| 7,246,996 | B2 * | 7/2007 | Harris | 415/177 |
| 7,287,955 | B2 * | 10/2007 | Amiot et al. | 415/173.2 |
| 7,309,209 | B2 * | 12/2007 | Amiot et al. | 415/173.2 |
| 2002/0053837 | A1 | 5/2002 | Arilla et al. | |
| 2005/0042080 | A1 | 2/2005 | Gendraud et al. | |
| 2007/0086887 | A1 * | 4/2007 | Pezzetti et al. | 415/173.1 |
| 2007/0140839 | A1 * | 6/2007 | Bucaro et al. | 415/178 |
| 2008/0112797 | A1 * | 5/2008 | Seitzer et al. | 415/116 |
| 2009/0053035 | A1 | 2/2009 | Zhang et al. | |

FOREIGN PATENT DOCUMENTS

| | | | |
|---|---|---|---|
| EP | 1 205 637 | A1 | 5/2002 |
| EP | 1 505 261 | A1 | 2/2005 |
| EP | 1 609 954 | A1 | 12/2005 |
| EP | 1 798 381 | A2 | 6/2007 |
| EP | 1 923 538 | A2 | 5/2008 |
| EP | 2 243 931 | A2 | 10/2010 |

OTHER PUBLICATIONS

Jul. 16, 2009 Search Report issued in corresponding British Patent Application No. 0906478.3.

Dec. 14, 2010 Search Report issued in European Patent Application No. GB1013723.0.

U.S. Appl. No. 13,177,122, filed Jul. 6, 2011 in the name of Steel, et al.

Aug. 9, 2013 Search Report issued in European Patent Application No. EP 10 15 6605.

* cited by examiner

*Primary Examiner* — Christopher Verdier
(74) *Attorney, Agent, or Firm* — Oliff PLC

(57) ABSTRACT

A turbine assembly having a bladed turbine wheel and a turbine casing (1000), extending axially of the turbine assembly, radially outwardly surrounding the tips of the blades of the turbine wheel, the casing having at least one radially outwardly extending dummy flange (2100, 2200) off which, in axial direction, one or more cooling manifolds (1100, 1200, 1300), wrapping radially outwardly around the casing, are mounted, the or each cooling manifold being adapted to receive cooling air and to discharge the cooling air radially inwardly towards the casing, for cooling the casing.

6 Claims, 6 Drawing Sheets

TURBINE CASING COOLING

The present invention relates to turbine casing cooling, for example in gas turbine engines.

In gas turbines engines it is necessary to control the clearances of the turbine blade tips from the turbine casing surrounding the tips, for example in order to minimise fuel consumption. This has been effected in various engines by using a shroud or cooling manifold placed circumferentially around the casing and blowing cold air onto the casing to reduce its diameter through reducing its temperature and thus limiting thermal expansion.

FIGS. 1A and 1B illustrate a prior cooling manifold A, which in use is wrapped around an engine (not shown), and air blows onto engine casings (not shown) through a series of small holes 4 shown best in the enlarged detail of FIG. 1B. Air is supplied/discharged via a manifold inlet/outlet defined inter alia by flanges 2 and 3. Bolt holes 1 provide for mounting of the manifold.

The synoptic view of FIG. 2A schematically illustrates a possible positioning of a cooling manifold A in relation to the casing and the rest of an engine.

As indicated in the exploded view of FIG. 2B the manifold A is attached to the engine via brackets and fastening means: see B, C, D, E in FIG. 2A, see also items 085, 100, 129, 130 131, 200, 202, 203, 206, 215, 217, 218, 220, 250, 273, 274, 275, 278, 279, 281, 400, 423, 424, 425, 429, 430, 431, 486, 489, 490, 492, (see also bolt holes 1 in FIG. 1A, which inter alia connect the manifold to the casing mounting flanges upstream and downstream). Flanges 2 and 3 (see eg FIG. 1B) on the manifold define inlet/outlet ducting for air supplied to the manifold A.

A simpler prior version of a cooling manifold A is shown in FIGS. 3A and 3B. Manifold tubes 1 have a series of inward facing holes 5, best seen in the enlarged detail of FIG. 3B, and blow air directly onto the casing surrounded by the manifold/tubes. The tubes are provided with anti-frettage liners 2 and assembly bolt holes 3 provided in flanges 4 for attachment of the tubes to inlet/outlet ducting (not shown).

This tube arrangement is attached to the engine via clips (not shown) mounted off brackets (not shown), which are in turn are mounted off adjacent casing mounting flanges (not shown).

Apart from mounting flanges casings may be provided with external dummy flanges/extensions designed to provide a larger area to increase the cooling effect and to stiffen the casing in the circumferential direction.

It has been found that prior cooling manifold arrangements provide for only poor control of the distance between manifold and casing which leads to uneven and low cooling rates. There is thus a need for an improved casing cooling arrangement.

The inventor has had the insight that dummy flanges, as opposed to casing mounting flanges, can be exploited to provide for better control of the radial distance between manifold and casing, and better axial positioning, which can lead to more even and higher cooling rates and thus an improved casing cooling arrangement Thus, according to the present invention there is provided a turbine assembly having a bladed turbine wheel and a turbine casing, extending axially of the turbine assembly, radially outwardly surrounding the tips of the blades of the turbine wheel, the casing having at least one radially outwardly extending dummy flange off which, in axial direction, one or more cooling manifolds, wrapping radially outwardly around the casing, are mounted, the or each cooling manifold being adapted to receive cooling air and to discharge the cooling air radially inwardly towards the casing, for cooling the casing.

The dependent claims indicates advantageous developments and embodiments of the invention.

Figure 1B:
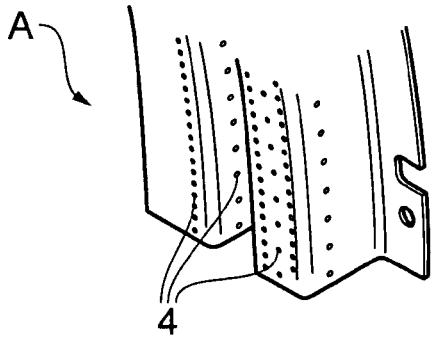
FIG. 1B Prior Art
FIG. 1B shows a detail of FIG. 1A to an enlarged scale.
Figure 1A:
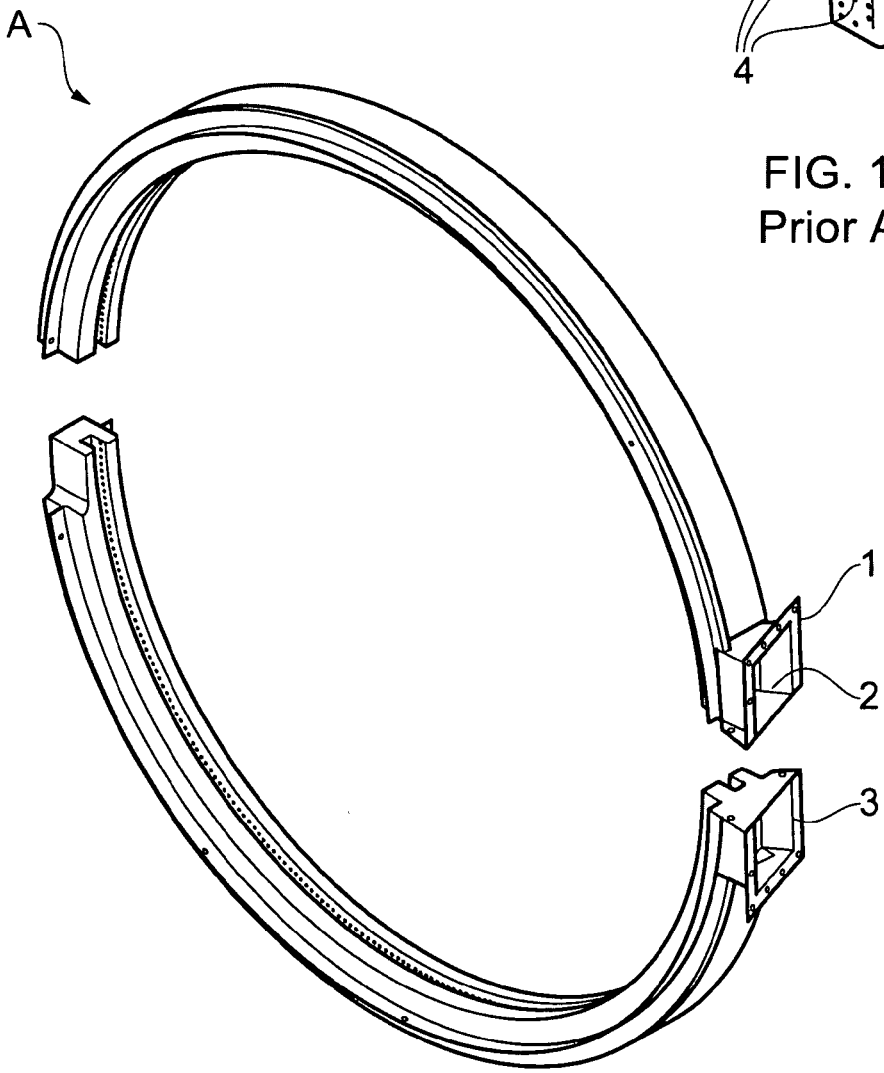
FIG. 1A Prior Art
FIG. 1A shows a schematic perspective illustration of a prior casing cooling manifold.
Figure 2A:
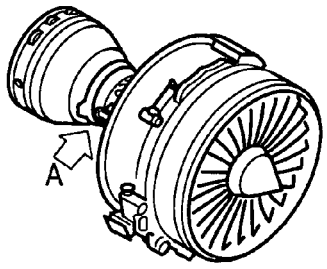
FIG. 2A Prior Art
FIG. 2A shows a schematic synoptic view illustrating a positioning of a casing cooling manifold in relation to the rest of a turbine engine.
Figure 2B:
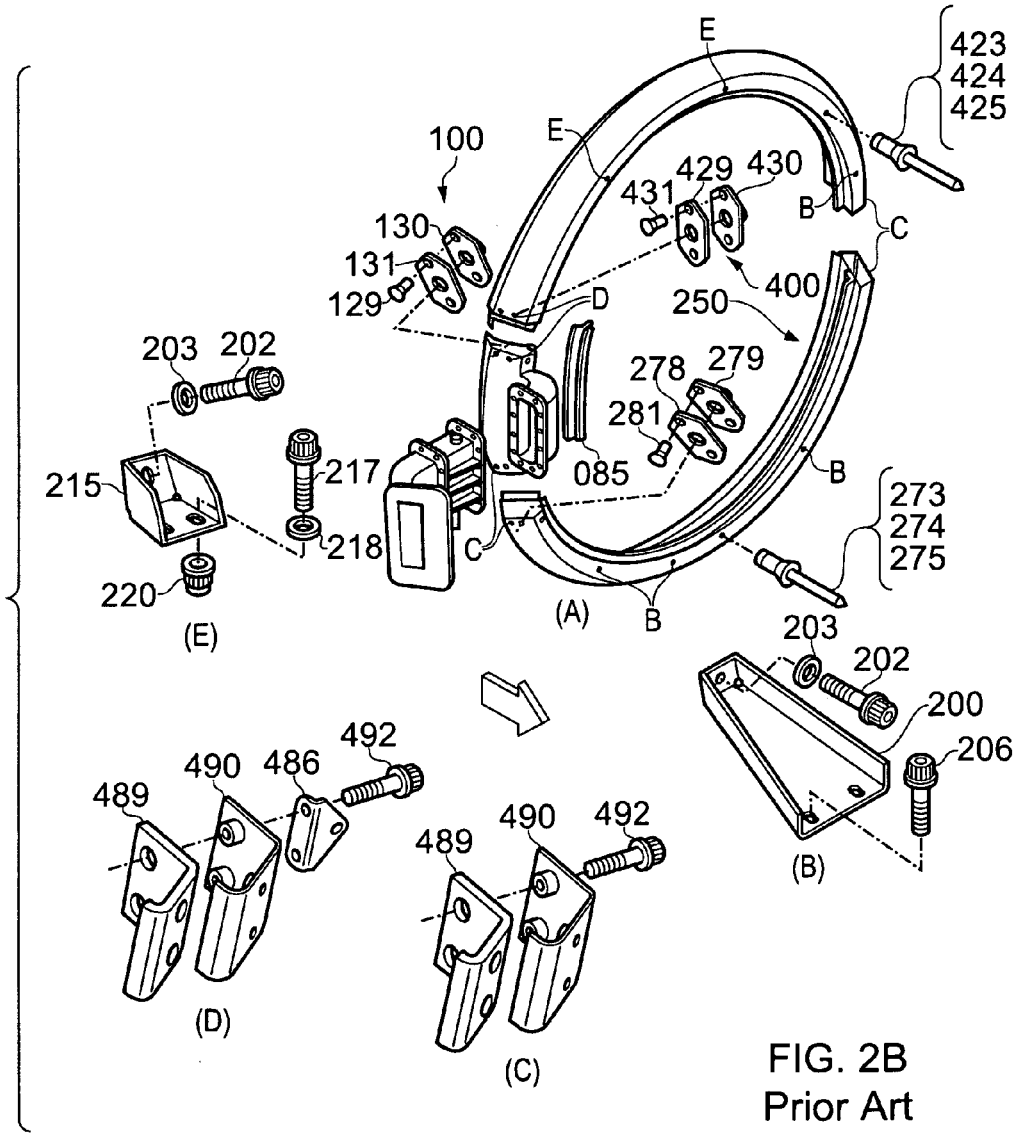
FIG. 2B Prior Art
FIG. 2B shows a schematic exploded view of a prior casing cooling manifold and related mounting parts.
Figure 3A:
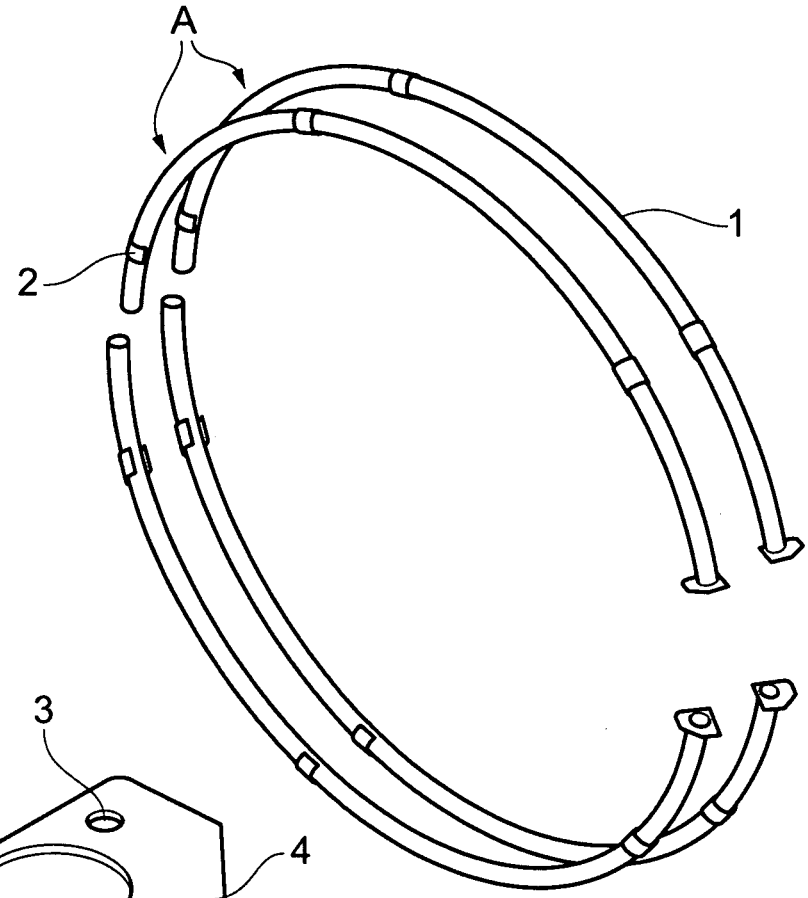
FIG. 3A Prior Art
FIG. 3A shows a schematic perspective illustration of a prior casing cooling manifold tube arrangement.
Figure 3B:
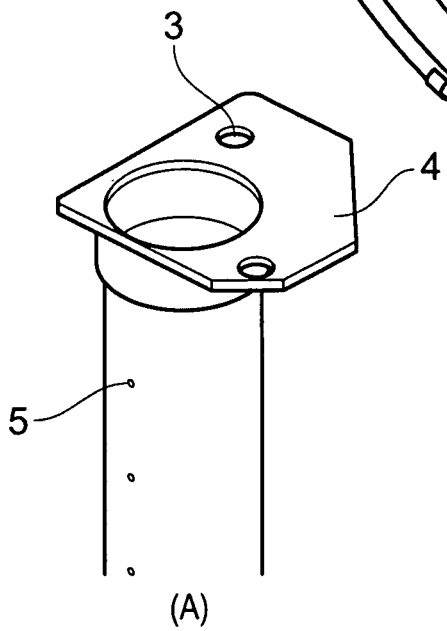
FIG. 3B Prior Art
FIG. 3B shows a detail of FIG. 3A to an enlarged scale.
Figure 4:
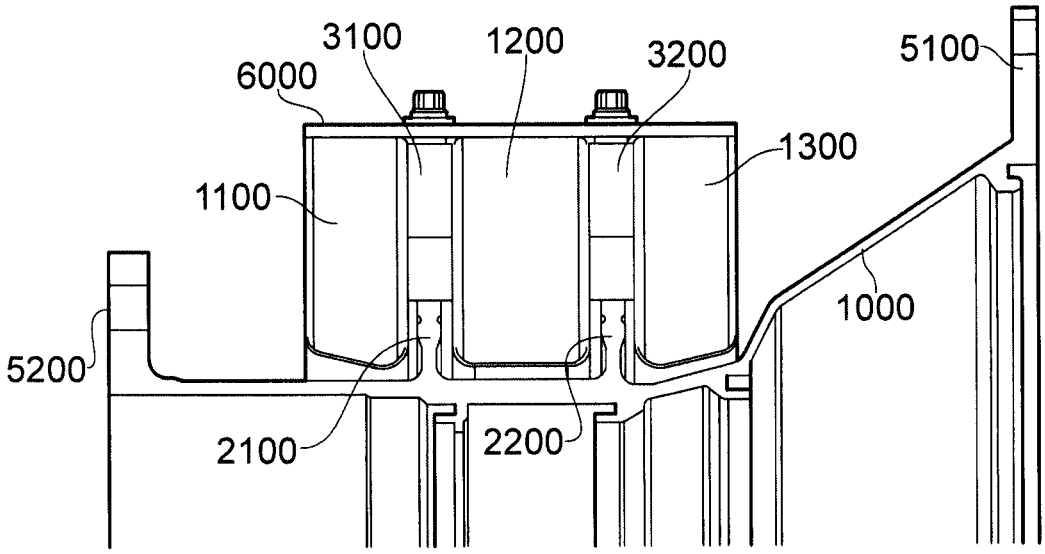
FIG. 4 shows a schematic cross-sectional view illustrating an embodiment of the present invention.

In the illustrated embodiment, three casing cooling manifolds 1100, 1200 and 1300 are mounted directly off two dummy flanges 2100, 2200 provided on the casing 1000 of a turbine assembly, as best illustrated in the cross-section of FIG. 4. A dummy flange is a flange which plays no part in mounting the casing in the engine or other equipment of the turbine assembly. In the illustrated embodiment separate mounting flanges 5100, 5200 serve for mounting the casing in the engine or other equipment to surround the tips of turbine blades of a turbine wheel of the engine or other equipment.

The cooling manifolds 1100, 1200 and 1300 receive cooling air at manifold inlets (not shown). The manifolds wrap around the casing and discharge cooling air onto the casing, by way of inwardly directed holes (not shown) in the manifolds (holes towards the casing) as in prior arrangements, or other inwardly directed discharge means such as slits or slots for example. Excess air can be released through a manifold outlet (not shown) for example as in prior arrangements.

The left (in FIG. 4) and right (in FIG. 4) dummy flanges 2100, 2200 are shown as having the same dimensions in the illustrated embodiment. In other embodiments of the invention the dummy flanges may have different dimensions as appropriate or necessary for design reasons.

Figure 6:
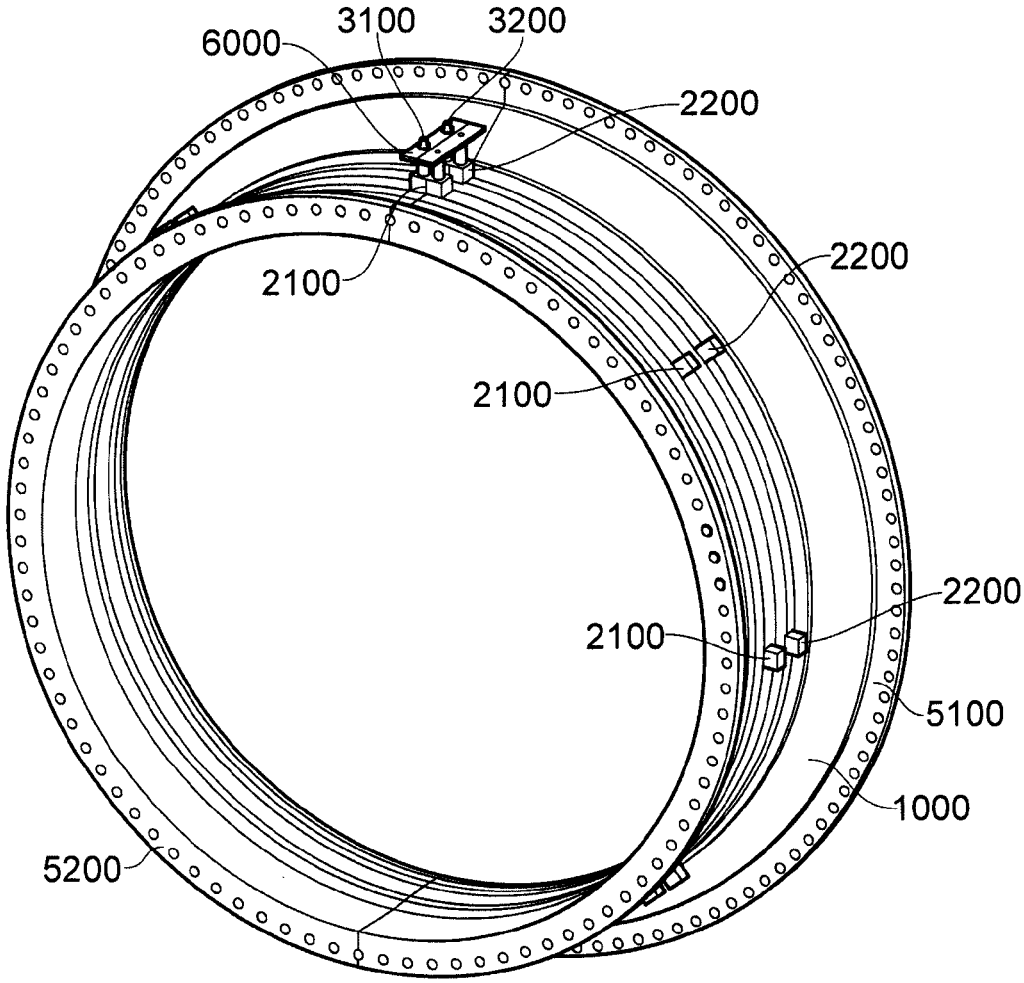
FIG. 6 shows a schematic perspective view illustrating the embodiment of the present invention with the casing cooling manifold removed.

Above each of the dummy flanges 2100, 2200, there is a mounting feature 3100, 3200. These mounting features are arranged around and can be considered to be parts of the dummy flanges as best illustrated in FIG. 4 or in the perspective view of FIG. 6 which shows the casing with manifold removed for clarity. In FIG. 6 the right hand mounting feature is cut away to show a bolt to fix the manifold onto a threaded insert within the mounting feature.

Above both mounting features 3100, 3200 there is provided a spacer 6000 that can be used to control and alter the radial displacement of the manifold and therefore control the distance between manifold and casing, eg by using spacers of different thicknesses.

In the illustrated embodiment, the dummy flanges 2100, 2200 are not continuous around the casing 1000 but are provided intermittently around the casing 1000. This can provide for reduced weight. In other embodiments, however, the dummy flanges may be continuous around the casing.

Figure 5:
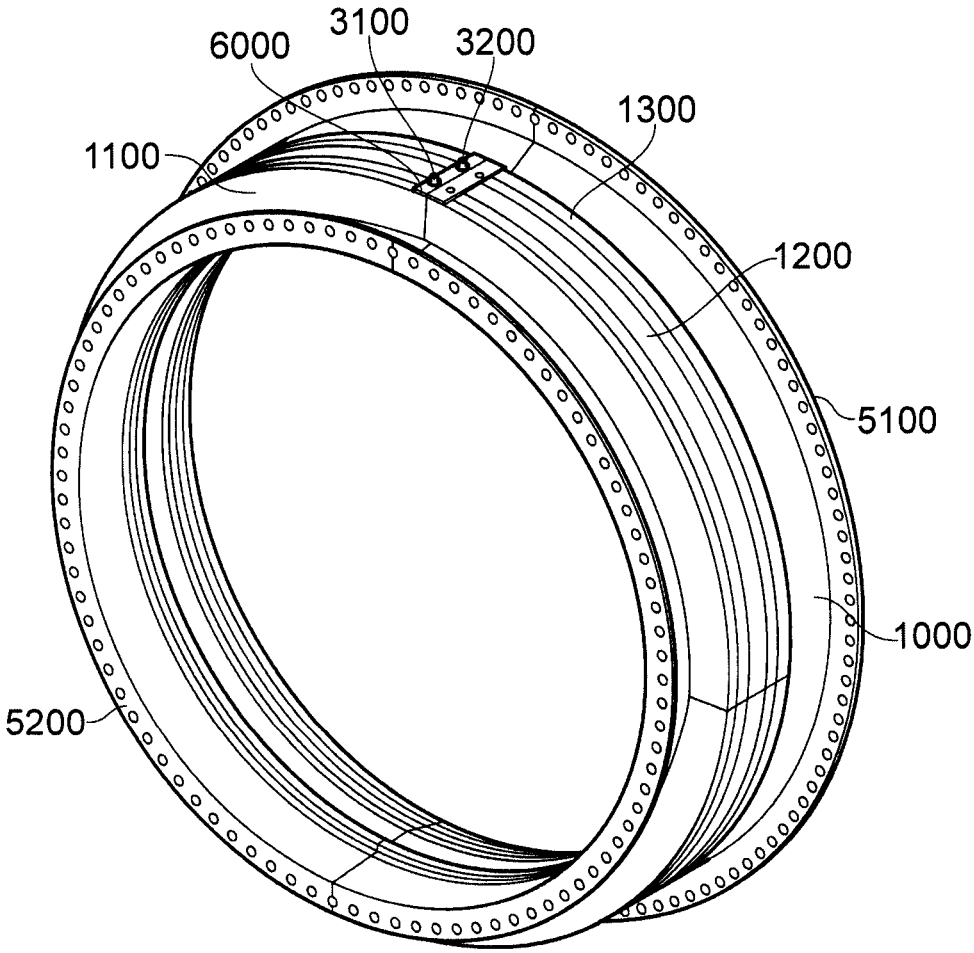
FIG. 5 shows a schematic perspective view illustrating the embodiment of the present invention.

As best illustrated in the perspective view of FIG. 5, the manifolds 1100, 1200, 1300 wrap around the casing 1000.

This arrangement allows better control of the radial gap because the number of manufactured features involved is fewer and the distances are lower and less susceptible to thermal distortion.

This means that tight control of the casing/blade tip gap can be maintained on new engines and during service operations. In service, the engine deteriorates such that the tip clearances increase because the gas temperature increases and this leads to hotter and larger diameter casings. This invention allows changes to be made to the spacers 6000 to adjust the radial gap and thus alter the cooling.

In other embodiments of the present invention more or less than two dummy flanges may provided, continuously or intermittently, of the same or different dimensions when a plurality of dummy flanges are provided, and casing cooling manifolds may be mounted directly off all or only some of the dummy flanges.

Although not specifically illustrated, it should be noted that axial distances can also be controlled in a similar manner to ensure better control of cooling on the faces of the dummy flanges. For example spacers could be connected to the sides of the mounting features to control the axial gaps.

Thus, in embodiments of the present invention axial and radial distances can be controlled better to give a more even and consistent cooling effect, and this independently of considerations or tolerances relating to mounting of the casing in the engine or other equipment. Thus the tip clearance is better controlled and, for example, engine performance is enhanced for both new engines and in service/deteriorated engines.

In comparison with prior proposals, in which a cooling manifold is mounted off the (mounting) flanges upstream and/or downstream of an area to be cooled and build-up of tolerances and differential thermal expansion is considered to lead to poor control of impingement height, the present invention can offer mounting on dummy flanges in the area to be cooled and provide for axial and radial distances to be controlled better to give a more even and consistent cooling effect.

The invention claimed is:

1. A turbine assembly comprising:

a bladed turbine wheel; and a turbine casing, extending axially of the turbine assembly, radially outwardly surrounding tips of the blades of the turbine wheel, the turbine casing having at least one radially outwardly extending dummy flange off which, in an axial direction, one or more cooling manifolds, wrapping radially outwardly around the turbine casing, are mounted, the turbine casing having two mounting flanges positioned axially on each side surrounding the at least one dummy flange, each of the one or more cooling manifolds being adapted to receive cooling air and to discharge the cooling air radially inwardly towards the at least one dummy flange, for cooling the turbine casing, wherein the one or more cooling manifolds are bolted directly to the at least one dummy flange, the bolting being directly in line with a longitudinal direction of the at least one dummy flange.

2. A turbine assembly as claimed in claim 1, wherein the one or more cooling manifolds are mounted off the at least one dummy flange with an interposition of an axial spacer, for adjusting an axial position of the one or more cooling manifolds.

3. A turbine assembly as claimed in claim 1, wherein the one or more cooling manifolds are mounted off the at least one dummy flange with a radial interposition of a spacer, for adjusting a radial position of the one or more cooling manifolds.

4. A turbine assembly as claimed in claim 1, having two dummy flanges off which three cooling manifolds are mounted, one axially between the dummy flanges, two axially outside the dummy flanges.

5. A turbine assembly as claimed in claim 1, wherein the or each dummy flange is continuous around the casing.

6. A turbine assembly as claimed in claim 1, wherein the or each dummy flange is intermittent around the casing.

* * * * *